United States Patent [19]

O'Hanlon

[11] 3,969,861

[45] July 20, 1976

[54] LEAKPROOF ROOF AND METHOD OF CONSTRUCTING SAME

[76] Inventor: Edward J. O'Hanlon, Assembly Point, Lake George, N.Y. 12845

[22] Filed: June 17, 1974

[21] Appl. No.: 480,600

[52] U.S. Cl. ..... 52/309; 52/417; 52/440

[51] Int. Cl.[2] ..... E04B 1/68; E04B 1/80; E04D 1/36

[58] Field of Search ..... 52/309, 324, 337, 440, 52/441, 434, 417, 469, 335; 404/49

[56] References Cited

UNITED STATES PATENTS

| | | | |
|---|---|---|---|
| 1,475,847 | 11/1923 | Marks | 52/335 |
| 1,599,549 | 9/1926 | Baldwin | 52/416 |
| 2,078,281 | 4/1937 | Rowley | 52/434 |
| 2,116,946 | 5/1938 | Huntington | 52/434 |
| 2,431,385 | 11/1947 | Fischer | 404/49 |
| 2,797,446 | 7/1957 | Miller | 52/90 |
| 3,323,267 | 6/1967 | Fish | 52/309 |
| 3,672,951 | 6/1972 | Moore | 52/309 |
| 3,783,563 | 1/1974 | Moore | 52/309 |

FOREIGN PATENTS OR APPLICATIONS

| | | | |
|---|---|---|---|
| 1,344,215 | 10/1963 | France | 52/309 |

*Primary Examiner*—Alfred C. Perham

[57] ABSTRACT

Roofs like other portions of buildings expand and contract with temperature changes in various climates and seasons. Regardless of outside temperature conditions there is almost no contraction and expansion in the roof described. Means and methods are devised for excluding all moisture from roof joints, thus the freezing and thawing conditions which usually exist are here absent. Unlike other roofs there is no overall expansion and contraction to open cracks to receive dampness, or to require roof repair or replacement. This is a permanent non expanding and non contracting roof structure.

6 Claims, 5 Drawing Figures a
a
1
2
9
40
4
12
9
2
1
3
6
7
11
4
11
7
6
3 b
a
a
b
1
8
13
50
2
1
8
13
50
2
1
3
10
5
3
2
3
10
5
3

LEAKPROOF ROOF AND METHOD OF CONSTRUCTING SAME

My roof is composed of insulating panels lying on purlins positioned at right angles to the panels, that are at their panel ends firmly fastened thereto.

Each panel is of comparatively small dimensions when considered as a relatively small area of the roof as a whole. Since the bottom sheet of each panel and the purlin on which it rests, and is fastened to, remains at a substantially constant indoor temperature, say 65° to 70° Fahr., the only expansion and contraction that can take place is that in the top sheet of each panel that from a practical aspect is nil considering the entire roof as a whole.

My panels are two flat sheets of a reasonably hard, smooth material, usually sheet metal, being filled between the two sheets with a foam (insulating foam) that becomes rigid. There is usually no change in the overall thickness of the roof panel. I prefer to have the crosswise and the lengthwise dimensions of the top sheet slightly smaller than the corresponding dimensions on the bottom sheet. Thus at the ends of each panel there is a slight overhang which permits its being fastened permanently and firmly to the purlin below it. While I turn flanges all around both sheets for added stiffness of the whole panel, this is not essential, and I can use my panels without such lengthwise or crosswise flanges on both panels as I have shown them in the drawings herein.

In constructing the roof I arrange my purlins in parallel rows, the purlins being equidistant from each other, and at right angles to the panels.

Unless the roof panel is so short as to extend only between two purlins . . . I desire that the panel extend between three purlins, one of these three purlins being under the panel and accordingly helping to support it in its position.

The roof as a whole is composed of lines of said roof panels, better placed end to end each pair of panel ends fastened firmly to the purlin supporting both ends or bottom panel sheets of the two abutting roof panels.

When it is finished the entire roof comprises several lines of roof panels each line being positioned closely adjacent to the line of roof panels it is next to. Here the sides of the bottom panel sheets touch each other throughout their entire length as they lie upon the roof and are fastened at their ends to said equidistant purlins.

In the adjacent lines of roof panels, I have found it desirable to have the panels positioned in an alternate arrangement, the ends (that abutt) in one line of panels, being close to the middle of the panels in each line of panels, one line of panels on each side, of the line of panels first referred to.

After the panels at their ends have been firmly fastened to the purlins, the roof is then ready to have all the cracks (the end cracks and the side cracks) filled with a foam that hardens. This can be called the secondary foaming operation.

Instead of foaming the spaces between the panels full to the tops of the panels with the foaming material, I prefer to foam only to within an inch below the top sheets of the panels. After the foam has hardened, I then fill this remaining inch of space with an elastomer, that is, rubber or a rubber like substance (such as R T V Silicone rubber) which definitely will come and go with temperature changes without opening up to let any moisture in on the foam. Over the silicon rubber (or the rubber cement) I lay on several layers of tar paper with plenty of tar or tarry like substance between the layers.

There is not enough temperature movement between the panels because they are all fastened to purlins (inside the building) that are all being held at constant temperature, to unfasten the rubber or rubber like material from the panels or cause the tar paper to separate from the roof panels or separate from each other. Thus my roof is tight and remains tight. Its life without repair or replacement, remains as it was originally constructed practically indefinitely.

Since it is produced from panels that are made in a factory by quantity production methods, and since the panels are themselves each of substantial dimensions, once the purlins are in place, the placement of the panels on the purlins and their being firmly fastened thereto, goes forward rapidly resulting in a roof of high and closely controlled quality, made with remarkable rapidity by relatively unskilled labor. The speed of roof production reduces the cost of the roof when it is built on borrowed money. Since the labor and cost of repair and replacement do not exist and since the roof is fire proof and weather proof, it embodies many desirable qualities.

In the drawings . . .

FIG. 1 shows the lines of panels designated by the letters *b* and *a* alternating across the roof, the *a* panels as a row alternating with the *b* panels also as an adjacent row of panels, on each side of and touching the *a* row of panels.

FIG. 2 shows the alternate pattern of the panels with respect to each other all the way across the entire roof.

Figure 1:
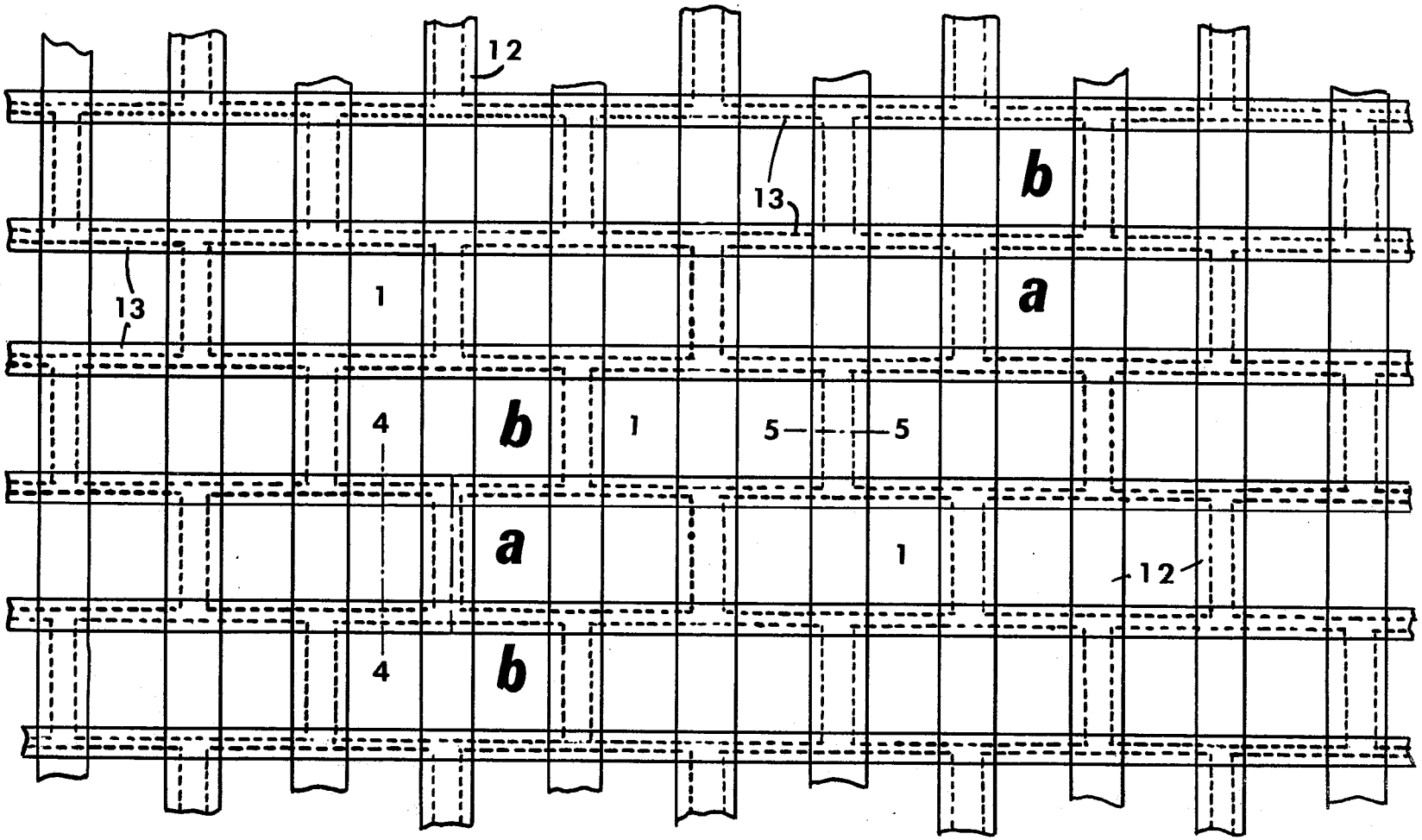
FIG. 1 is a plan view looking down on the roof as completed.

In FIG. 1 the tops of each panel is shown by the numeral 1. The longitudinal lines of tar paper shown as numeral 13, the lateral lines of tar paper cover (over the cracks between the ends of the panels) being given the numeral 12 as in line with FIG. 5.

Figure 2:
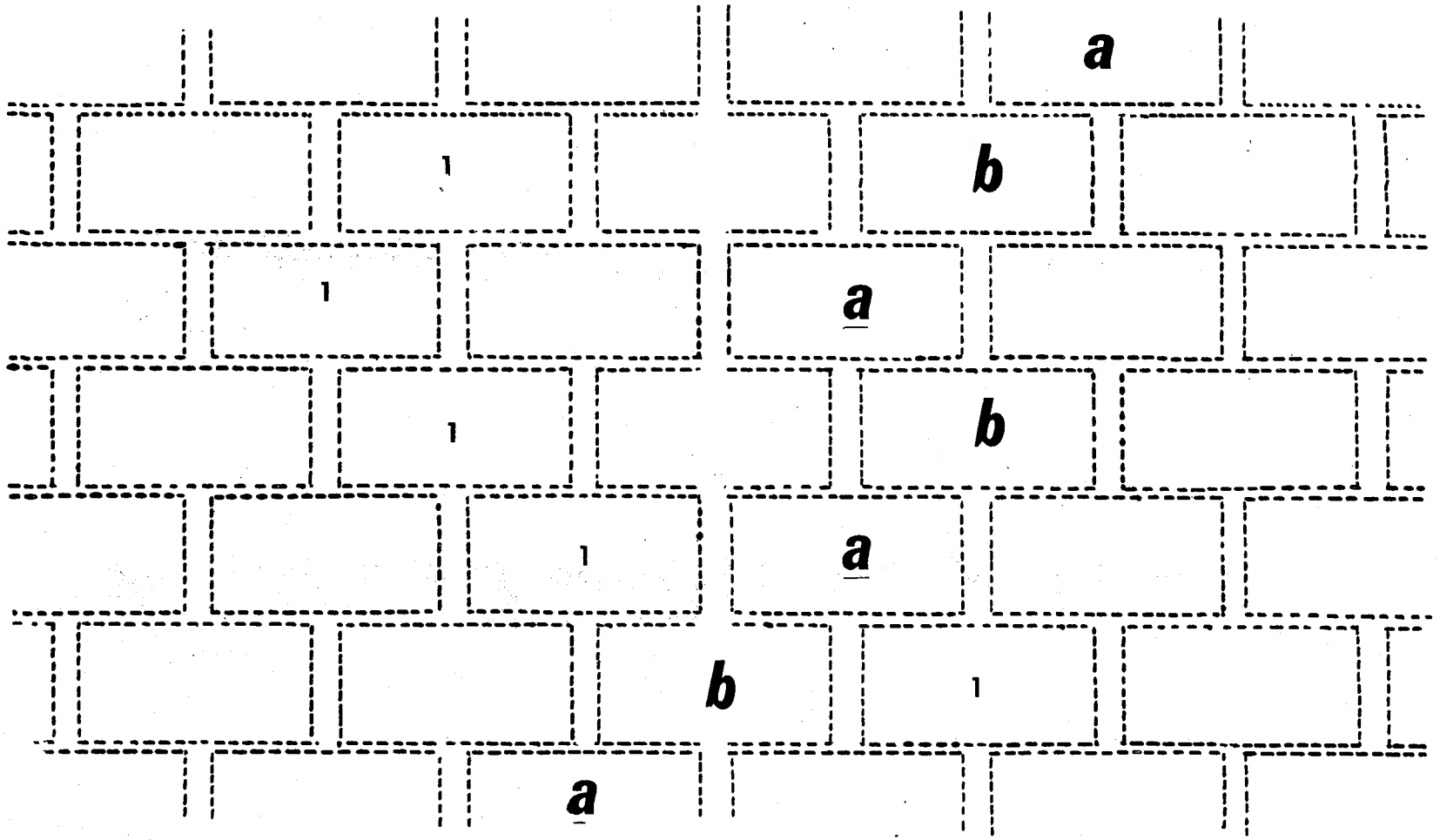
FIG. 2 shows the alternate positioning of the lines of roof panels and of the panels themselves with respect to each other.
Figure 3:
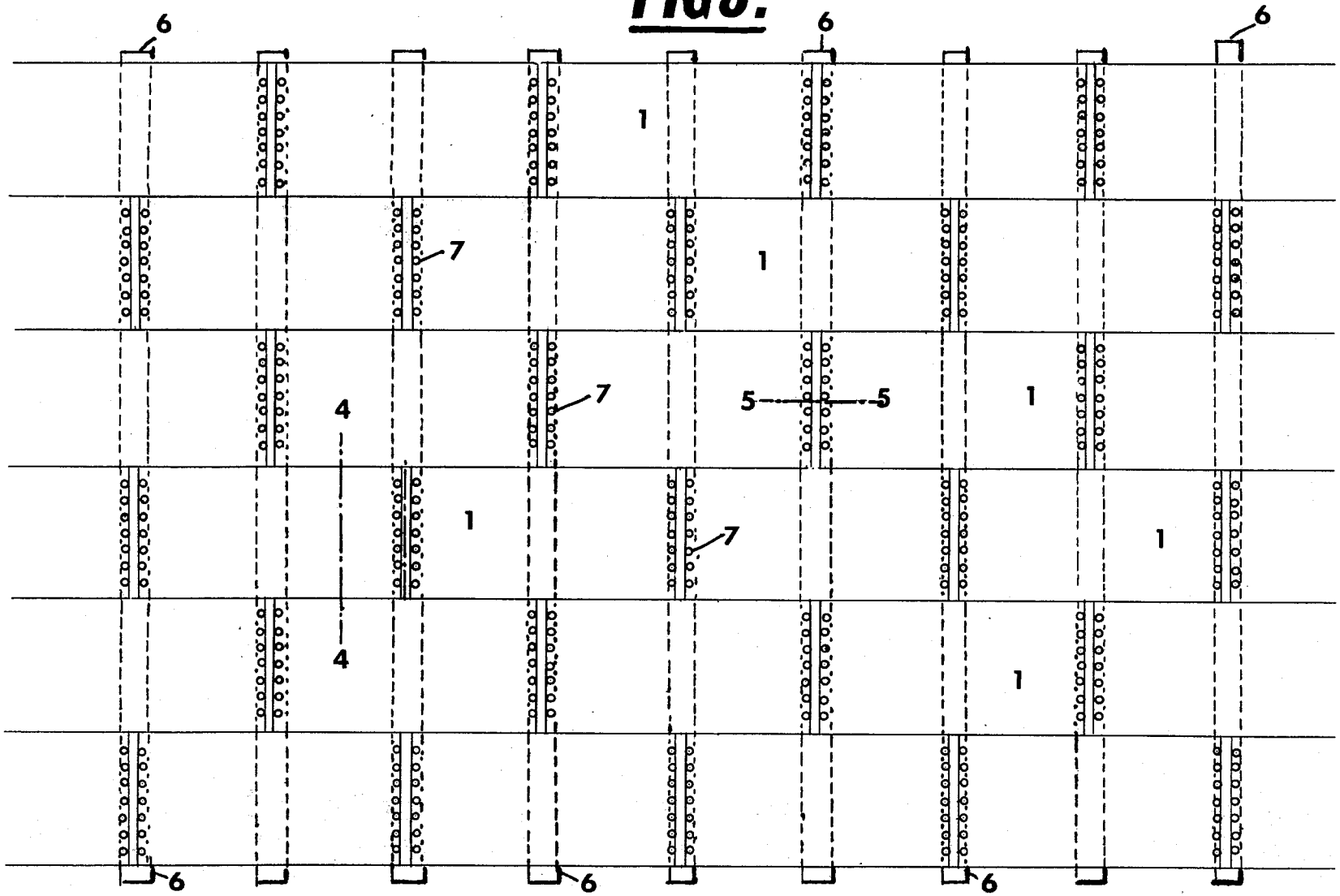
FIG. 3 is the roof panel fastening pattern as the panels sit upon the purlins and are in the case of each panel firmly fastened thereto.
Figure 5:
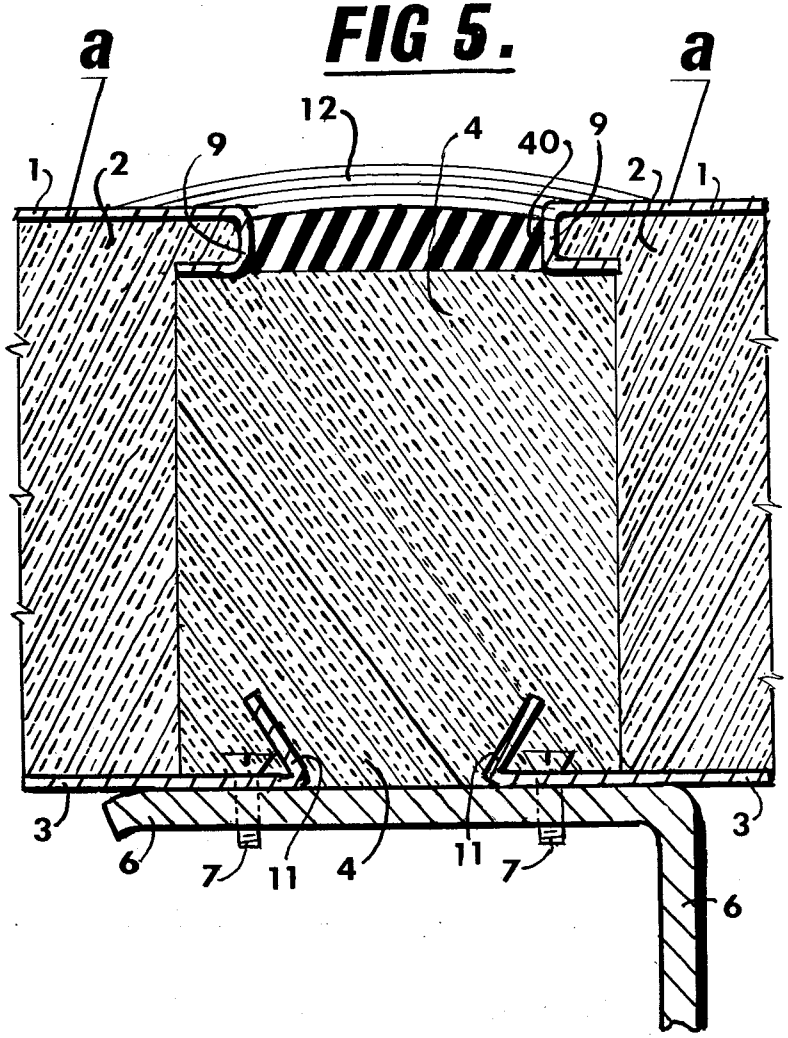
FIG. 5 shows in section how the panels lying crosswise sit upon and are firmly each fastened to the purlins, serviced with rubber and tar paper, and made thoroughly water proof and weatherproof.
Figure 4:
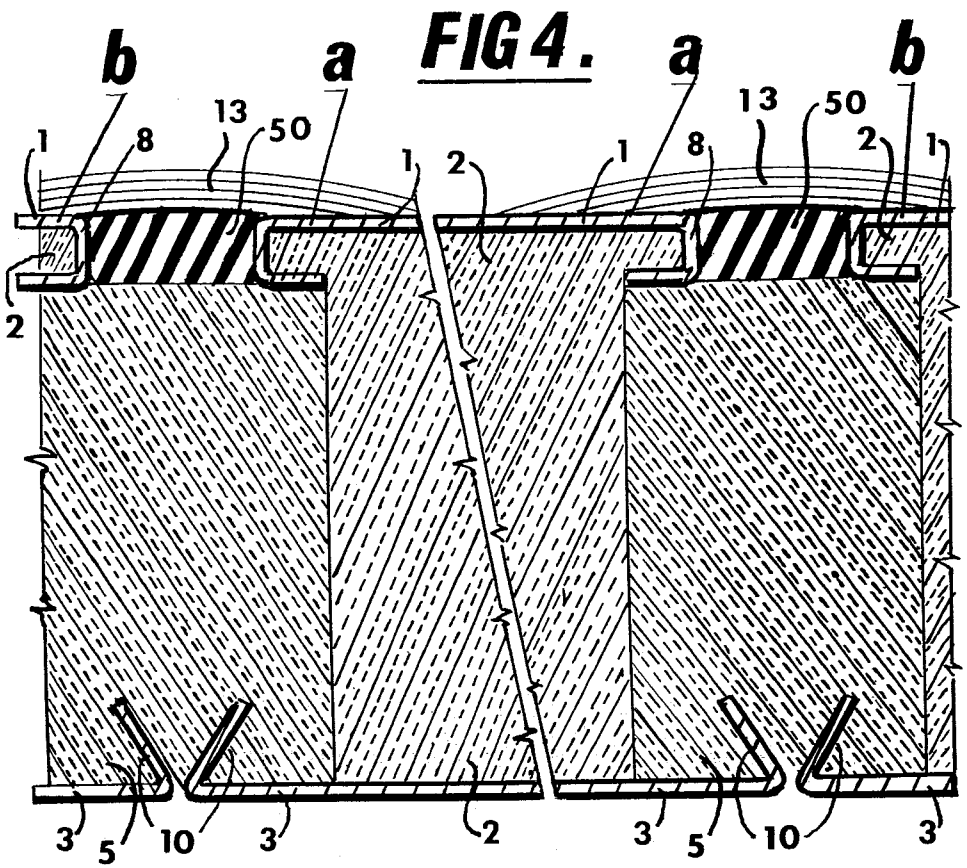
FIG. 4 shows in section how the panels lying lengthwise are foamed together and serviced with rubber and tar paper, and made thoroughly water and weather proof.

While the drawing in FIG. 1, FIG. 4 and FIG. 5 are actual drawings of my invention, the drawings in FIG. 2 and FIG. 3 are diagrammatic.

In FIG. 1 the section numeraled 4 — 4 is the section taken through my roof as shown in detail in FIG. 4. The section numeraled 5 — 5 through my roof is the section shown in detail in FIG. 5 of the drawings herein. As a matter of fact the dimensions of the drawings in FIG. 4 and in FIG. 5 are the actual dimensions I use in making my best form of roof as I build it.

In diagrammatic FIG. 2 the position of the roof panels are substantially the same position as shown in plan in FIG. 1, the tops of the roof panels here bearing the numeral 1 as shown in FIG. 4 and FIG. 5.

It is to be understood that the A panels are identical to the B panels. All the roof panels are exactly alike whether they are *a* panels or *b* panels. All panels are also of the same uniform thickness all across each panel.

In diagrammatic FIG. 3 I show the panel fastening pattern, the way the panels are positioned end to end and with the fastening screws 7, 7, 7, and 7 are fastened firmly to the purlins two panels to one purlin at both ends of each panel. Here again in the diagrammatic FIG. 3 the sectional lines 4 — 4 represent the section shown in FIG. 4 the lines 5 — 5 representing the sectional view of my roof as illustrated in FIG. 5 (five).

In FIGS. 4, and 5, the parts bearing numerals are . . . 1: top sheet panel cover, 2: foam (rigid foam) between bottom sheet 3 and top sheet 1, 3: bottom sheet panel cover, 4: later foam insert between the ends of the panels after they have been firmly fastened to the purlin 6. 5: are the later foam inserts between the side of the panels after they have all been fastened together on their respective purlins. 6: is the purlin shown throughout the drawings. 7: are the screws shown in FIG. 5 and in the diagrammatic panel fastening pattern in FIG. 3. 40 is the flexible waterproof insert between the tops of the panels as these rubber inserts run across the panels in FIG. 5 or as they run lengthwise in FIG. 4 between the sides of the panels . . . carrying the numeral 50. 8: is the flange of the top panel sheet 1 running lengthwise the panel. 9: is the flange of the top panel sheet 1 along the end of the panel. 10: shows the flange on the bottom panel sheet 22 along the long edge of the panel. 11: shows the flange on the bottom sheet 2 across the end of the panel. 12: indicates the tar paper cover over the rubber like material in the foamed spaces crosswise the roof. 13: indicates the tar paper cover over the rubber like material in the foamed spaces lengthwise the roof.

It is understood that where there is metal exposed that can either rust or corrode, this metal may be covered with long lasting plastic paint. If the top sheets of the panels are of plastic sheets any corrosion is simply not likely to take place.

Let it also be noted that there is much strength to be gained where the foam 4 later applied in FIG. 5, comes down and siezes tightly the top of the purlin 6. Since the purlins are always at more or less constant temperature, this assures little or no movement between the panels on the rest of the roof. The amount and depth of the later inserted rubber or rubber like substance and the fact that it sticks strongly to the upper flanges of the panels as at numerals 8 and 9 is more correctly shown in FIG. 4 and FIG. 5. The type of rigid foam I use has about a 5% memory (or recovery) when expanded or contracted. The roof without exception has the greatest heat insulation efficiency of any roof yet previously produced.

I claim:

1. A substantially non-expanding and non-contracting roof or top cover of a building or part thereof, on which rain, hail, snow or ice accummulates and which is subject to the wide seasonal changes in temperature but which is without any roof cover covering said roof as a whole, said roof comprising similar flat panels, each panel composed of rigid foam held tightly between two sheets with hard surfaces, said panels resting on and fastened to purlins, and at right angles to said purlins, said flat panels being closely adjacent to each other, and placed in lines end-to-end and closely side-by-side, the contiguous ends of adjacent panels fastened firmly to the same purlin, and means closing and waterproofing the narrow spaces between the sides and the ends of said panels by being further joined laterally and longitudinally by a secondary application of foam substantially filling the crosswise and lengthwise spaces between the panels and, and an elastic cover positioned on and waterproofing over said secondary application of foam.

2. The invention as claimed in claim 1, wherein said elastic cover is rubber.

3. The invention as claimed in claim 2 including a further tarry like material covering said rubber.

4. The invention as claimed in claim 1, including a tarry like material covering said elastic cover.

5. The invention as claimed in claim 4, including a strip of tar paper covering said tarry like material.

6. The invention as claimed in claim 1 and a strip like layer over said elastic cover.

* * * * *